US006009953A

United States Patent [19]

Laskaris et al.

[11] Patent Number: 6,009,953

[45] Date of Patent: Jan. 4, 2000

[54] FOAM PUMP SYSTEM FOR FIREFIGHTING APPARATUS

[75] Inventors: Michael Laskaris, Collegeville; Richard Teske, Norristown, both of Pa.

[73] Assignee: Hale Products, Inc., Conshohocken, Pa.

[21] Appl. No.: 08/806,045

[22] Filed: Feb. 25, 1997

[51] Int. Cl.[7] ..... A62C 27/00

[52] U.S. Cl. ..... 169/13; 169/15

[58] Field of Search ..... 169/13, 14, 15, 169/24

[56] References Cited

U.S. PATENT DOCUMENTS

| | | | |
|---|---|---|---|
| 2,758,547 | 8/1956 | Wendell et al. | 417/201 |
| 3,846,515 | 11/1974 | Williamson | 261/18.3 |
| 4,259,038 | 3/1981 | Jorgensen et al. | 417/53 |
| 4,337,830 | 7/1982 | Eberhardt | 169/24 |
| 4,436,487 | 3/1984 | Purvis et al. | 417/46 |
| 4,587,862 | 5/1986 | Hoffman | 74/15.88 |
| 4,633,895 | 1/1987 | Eberhardt | 137/98 |
| 4,694,228 | 9/1987 | Michaelis | 388/819 |
| 4,751,439 | 6/1988 | Buchwald et al. | 388/801 |
| 4,795,314 | 1/1989 | Prybella et al. | 417/43 |
| 4,833,586 | 5/1989 | Inaba et al. | 363/41 |
| 4,899,825 | 2/1990 | Bosoni et al. | 169/14 |
| 4,983,891 | 1/1991 | Sekimoto | 318/66 |
| 5,096,389 | 3/1992 | Grady | 417/364 |
| 5,145,014 | 9/1992 | Eberhardt | 169/14 |
| 5,156,005 | 10/1992 | Redlich | 62/6 |
| 5,174,383 | 12/1992 | Haugen et al. | 169/15 |
| 5,218,988 | 6/1993 | McNamara et al. | 137/101.21 |
| 5,232,052 | 8/1993 | Arvidson et al. | 169/14 |
| 5,494,112 | 2/1996 | Arvidson et al. | 169/13 |

FOREIGN PATENT DOCUMENTS

| | | |
|---|---|---|
| 40 595 | 11/1981 | European Pat. Off. . |
| 29 46 298 | 5/1981 | Germany . |
| 3817852 | 7/1989 | Germany . |
| 671819 | 7/1979 | U.S.S.R. . |
| 796055 | 6/1958 | United Kingdom . |

OTHER PUBLICATIONS

Article: "Engineering analysis of Threshold Compressed Air Foam Systems (CAFS)" by Dan McKenzie, published Oct. 1987, U.S. Dept. of Agriculture.

Article from *The Fireman* entitled "Merryweather Fire Fighting Equipment on Trinity House Vessel 'Patricia'", published Mar. 1938.

Article: "Foam As A Fire Suppressant: An Evaluation" by Schlobohm and Rochna, published 1987, U.S. Dept. of Agriculture.

(List continued on next page.)

*Primary Examiner*—Andrew C. Pike
*Attorney, Agent, or Firm*—Hill & Simpson

[57] ABSTRACT

A foam pump system for injecting chemical foamant into a firefighting stream includes a water pump, a foam pump, and an optional air compressor which are all connected to a common transmission. The transmission includes an input shaft which may be connected to a single power source (such as an engine of a fire truck) for driving the water pump, foam pump, and air compressor. The water pump, foam pump, and air compressor are preferably mounted (directly or indirectly) on the transmission to provide a compact unit that may be sold in modular form for ready incorporation into a firefighting apparatus such as a fire truck. The system also advantageously includes a hydrostatic transmission for selectively and accurately driving and controlling the speed of the foam pump and the resultant proportion of chemical foamant that is injected into the fire fighting stream. The hydrostatic transmission preferably includes a hydraulic motor for driving the foam pump and a variable displacement hydraulic pump for driving the hydraulic motor. By varying the displacement of the hydraulic pump, the speed of the foam pump can be selectively and accurately controlled. The displacement of the hydraulic pump is controlled with an ellectrically operated actuator, such as a hydraulic actuator, a pneumatic actuator, or an electrical solenoid. The system also includes a flow control system for measuring the flow rates of the foam and fire stream and for selectively controlling the proportion of chemical foamant introduced into the fire stream by adjusting the speed of the foam pump with the actuator and hydrostatic transmission.

22 Claims, 7 Drawing Sheets

OTHER PUBLICATIONS

W.S. Darley & Co., *Darley Champion—SEH, Fire Pumps*, Jun. 1981.

Hale Fire Pump Company, *2HPC Pump Air Clutch Assembly*, Plate No. 704, Oct. 23, 1989.

Hale Fire Pump Company, *Hale Type QL QL2 QL3 QL4 Pump*, Plate No. 360, Jul. 8, 1953.

Hale Fire Pump Company, *Hale Type ZM Pump*, Plate No. 120, Jan. 15, 1936.

FOAM PUMP SYSTEM FOR FIREFIGHTING APPARATUS

BACKGROUND OF THE INVENTION

This invention relates generally to firefighting equipment and more particularly to a system for introducing chemical foamant into a fire fighting stream.

Systems for introducing chemical foamants and/or compressed air into a firefighting stream are known and are referred to in the art by the terms CAFS (compressed air foam systems) and WEPS (water expansion pumping systems). A typical system includes a foam injection system, a water pumping system, and an air compressor. When employing mixture ratios of 1 cfm of air to 1 gpm of water, these systems can produce very desirable results in firefighting by the use and application of "Class A or B" foams to help achieve fire suppression and to deal with increased fire loads and related hazards.

One system which includes a foam injection system, a water pumping system, and an air compressor is disclosed in co-owned U.S. Pat. No. 5,145,014. The system includes an air compressor for injecting air into the fire stream and includes a foam injection system in the form of a foam proportioner which injects chemical foamant into the fire stream. The foam proportioner is powered by drawing water off of the fire stream, which reduces the pressure head of the fire stream. In addition, the foam proportioner does not include any mechanism for specifically selecting and controlling the proportion of chemical foamant that is introduced into the water stream flowing through the fire hose. For a more detailed description of such a foam proportioner, reference may be had to co-owned U.S. Pat. No. 4,633,895.

Other systems for introducing a chemical foamant into a water stream are disclosed in U.S. Pat. Nos. 5,232,052 and 5,494,112. In such constructions, the foam pumps are lowered by electric and/or hydraulic motors. However, the electric motors and hydraulic motors require a power source which must be mounted on the fire fighting apparatus, such as a fire truck. The addition of such a power source to the fire fighting apparatus is expensive, space consuming, and adds weight to the fire fighting apparatus.

Accordingly, it is believed that it would be an improvement in this art to provide a foam injection system which does not require an additional power source and which permits selective and accurate control of the proportion of chemical foamant introduced into the fire stream.

SUMMARY OF THE INVENTION

The present invention advantageously provides a unitary foam injection system which can be powered by the engine of the fire fighting apparatus and which permits selective and accurate control of the proportion of chemical foamant introduced into the fire stream. Such results are achieved by mounting the water pump, foam pump, and air compressor on a common gearbox or transmission to form a modular unit that may be readily incorporated into a fire fighting apparatus such as a fire truck. The common gearbox box or transmission can be connected to the engine of the fire truck, for example, so that the power take off from the engine can be used to selectively drive the water pump, foam pump, and/or air compressor. Accordingly, the foam injection system of the present invention does not require a separate power source mounted on the fire fighting apparatus for powering the foam injection system. In addition, the system of the present invention advantageously utilizes a power train having an hydrostatic transmission between the transmission housing and foam pump to permit selective and accurate control of the speed of the foam pump and the resultant proportion of chemical foamant that is introduced into fire stream.

In one embodiment, the foam injection system includes a transmission having a housing and drive means disposed in the housing for driving components connected to the transmission. The transmission is advantageously connected to the engine of a firefighting apparatus for driving the transmission and the components connected to the transmission. The system also includes a water pump and a foam pump which are operatively connected to and driven by the drive means of the transmission. The system also includes a first conduit means for receiving fluid from the water pump and discharging the fluid through a nozzle and onto a fire. A second conduit means is also provided in fluid communication between the foam pump and the first conduit means for injecting a desired amount of chemical foamant into the fluid flowing through the first conduit to provide a foam and fluid mixture for discharge through the nozzle and onto a fire.

The foam pump is connected to the transmission by a drive train. Preferably, the drive train includes a clutch for selectively engaging and disengaging the foam pump and a hydrostatic transmission for controlling the speed of the foam pump. In one embodiment, the hydrostatic transmission includes a hydraulic motor for driving the foam pump and a variable displacement hydraulic pump for driving the hydraulic motor. The variable displacement hydraulic pump circulates fluid through and drives the hydraulic motor which in turn drives the foam pump. By controlling the displacement of the hydraulic pump, the resultant speed of the hydraulic motor and foam pump can be accurately controlled.

Control means are operatively connected to the variable displacement pump of the hydrostatic transmission for selectively varying the displacement of the pump to control the speed of the hydraulic motor and the foam pump. In one embodiment, the control means comprises a mechanical actuator that actuates a mechanical rod for adjusting the displacement of the hydraulic pump. For example, the mechanical rod can adjust the orientation of a swashplate to correspondingly adjust the displacement of the hydraulic pump. The actuator may take the form of any one of a number of well known actuating devices. For example, the actuator may take the form of a hydraulic actuator, a pneumatic actuator, or electric actuator. The pneumatic actuator may be advantageously powered by connection to the air brake system of a fire truck, and the electric solenoid can be advantageously powered by connecting it to the electrical system of the fire truck.

The water pump and foam pump are preferably connected to and mounted (directly or indirectly) on the housing on the transmission. The water pump, foam pump, and transmission combination form a modular or unitary device that may be easily incorporated into the firefighting apparatus. In some embodiments, the system will also include an air compressor for aerating the fire stream. The air compressor is preferably connected to and mounted (directly or indirectly) on the transmission housing as well to form a modular or unitary device. In embodiments which employ an air compressor, a third conduit means is provided for injecting compressed air from the air compressor into the fluid flowing through the first conduit so that an aerated fire stream is discharged through the nozzle and onto the fire.

Other objects, features, and advantages of the present invention will become apparent from the following description and drawings.

DETAILED DESCRIPTION OF THE PREFERRED EMBODIMENTS

Figure 1:
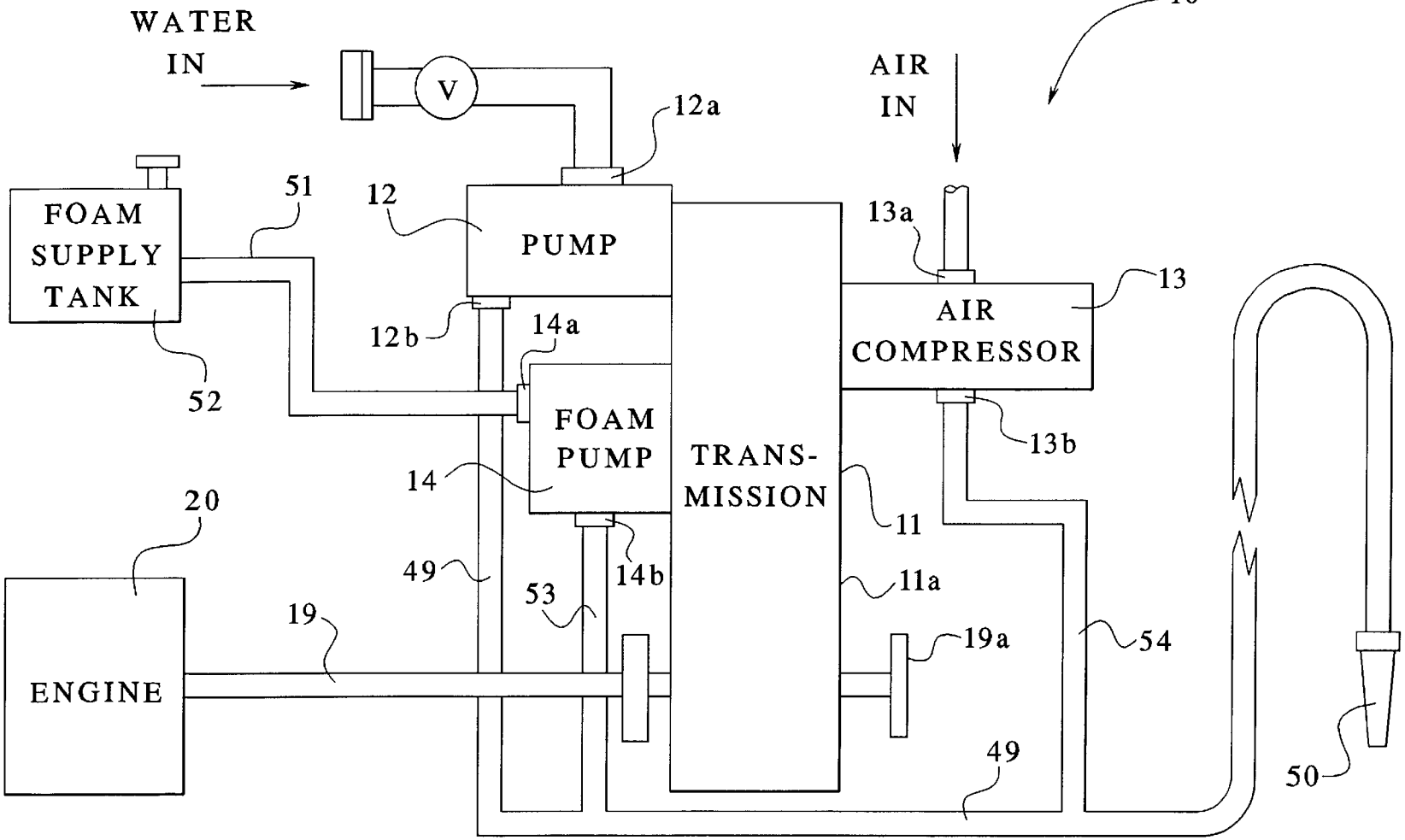
FIG. 1 is a schematic view of the fire fighting system of the present invention.
Figure 2:
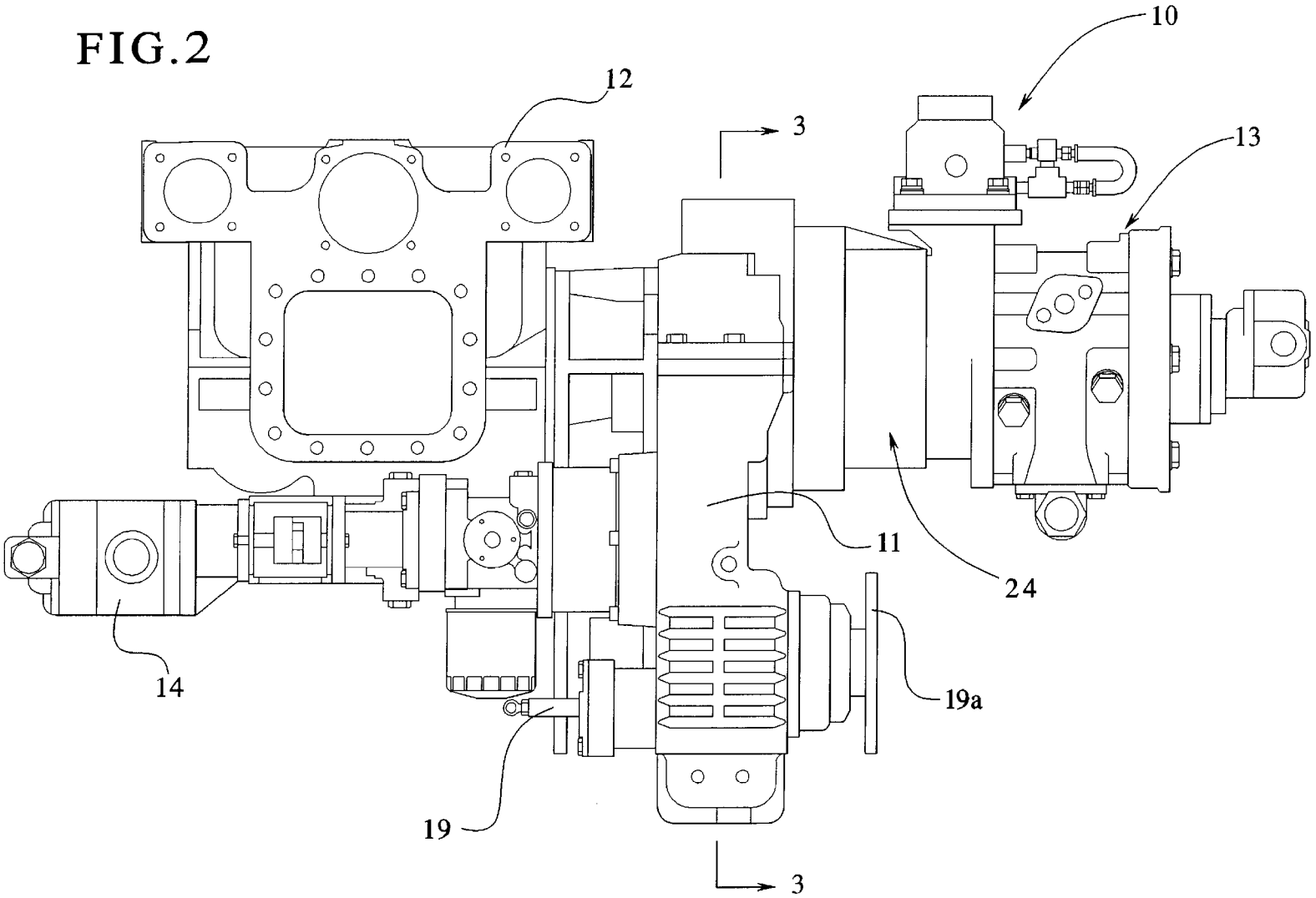
FIG. 2 is a front elevational view of the fire fighting system of the present invention.

Referring to FIGS. 1 and 2, the numeral 10 generally designates the foam injection system of the present invention for producing a firefighting stream and proportionally introducing chemical foamant (and compressed air in some embodiments) into the fire stream. System 10 includes a transmission 11, a water pump 12, an optional air compressor 13, and a foam pump 14. As used herein, the term "foam pump" refers to a pump for pumping chemical foamant for later injection into a fluid stream to create a foamed fire stream. The system 10 of this invention may be incorporated into conventional firefighting apparatus, such as fire trucks and the like.

The transmission 11 includes a transmission housing 11*a* and comprises a split shaft gearbox of the type used on fire trucks as a transmission for driving the midship fire pump. The fire or water pump 12 is such a midship pump of the type used on fire trucks and may comprise, by way of example, a GSMG 150 midship pump manufactured by the Hale Products, Inc. However, other suitable midship fire pumps may be used in accordance with the teachings of this invention.

Figure 3:
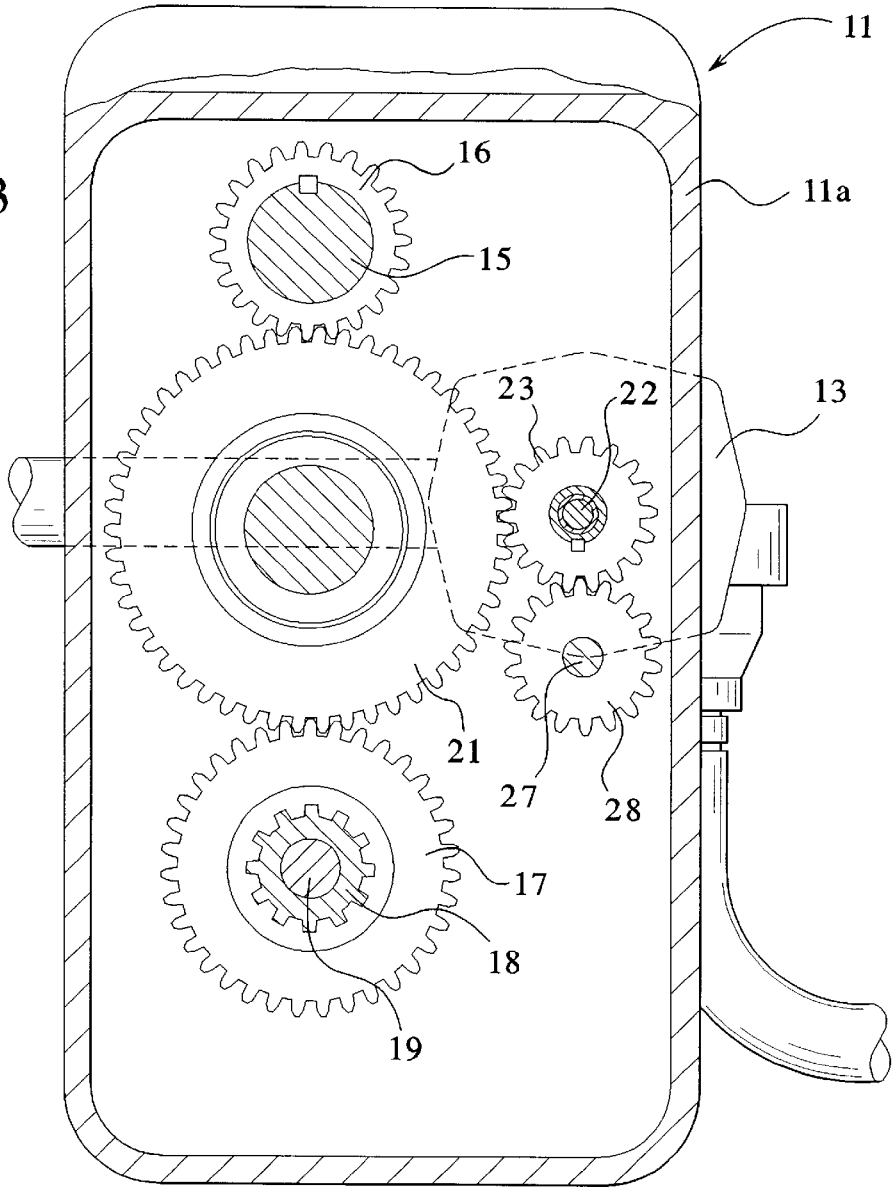
FIG. 3 is a sectional view taken generally along line 3—3 of FIG. 2.

The fire pump 12 includes a pump drive shaft 15 which extends into transmission 11 as shown in FIG. 3. The drive shaft 15 includes a pump drive gear 16 and is rotatably mounted in the upper portion of the housing 11*a* of transmission 11. As shown in FIG. 2, the pump 12 is preferably connected to and mounted (directly or indirectly) on the transmission housing 11*a* by suitable mounting members, bolts, or the like.

The transmission 11 for driving the fire pump 12 is essentially the same as the transmission shown in U.S. Pat. No. 4,587,862, which discloses a split shaft gear box of the type in use today on fire trucks for driving fire pumps. Briefly, the transmission 11 includes in the lower portion of housing 11*a* a sliding gear 17 which is slidably mounted on a splined portion 18 of an input shaft 19 (splined portion 18 and shaft 19 are one integral component but are cross-hatched differently to emphasize the different portions). The input shaft 19 is rotatably mounted in the housing 11*a* and is connected to a power source such as an engine 20 (FIG. 1) of a fire truck. The input shaft 19 also extends through the transmission 11 and includes drive member 19*a* for driving the wheels of a fire truck, for example.

In a conventional fashion, the slidable gear 17 is moveable along splined portion 18 between a "road" position in which slidable gear 17 is not engaged with the intermediate gear 21 and a "pump" position in which the slidable gear 17 is engaged with the intermediate gear 21. In the "road" position, the fire truck engine 20 can be operated for traveling along a road and gear 17 spins without engaging intermediate gear 21. In the "pump" position, the slidable gear 17 is in engagement with intermediate gear 21 which in turn rotates pump drive gear 16 and pump drive shaft 15 to operate the fire pump 12. The slidable gear 17 may also be shifted to a "neutral" position as is conventional. For a more detailed description of the operation of the split shaft gear box, reference may be had to co-owned U.S. Pat. Nos. 4,587,862 and 5,145,014, which are hereby incorporated by reference.

The intermediate gear 21 of transmission 11 acts as a drive means for driving components connected to the transmission. For example, the intermediate gear 21 can be used to power an optional air compressor 13 when it is desired to be able to inject compressed air into the fire fighting stream. Such a construction is conventional and is disclosed in co-owed U.S. Pat. No. 5,145,014. Briefly, the air compressor 13 may be a sliding vane type rotary compressor of conventional construction. The compressor 13 includes a drive shaft 22 having a compressor drive gear 23 secured thereon by means of a key or other suitable securement means. The compressor drive gear 23 is positioned within the housing 11*a* of transmission 11 such that it engages intermediate gear 21. When the slidable gear 17 engages and drives intermediate gear 21, the intermediate gear 21 drives both the pump drive gear 16 and the air compressor drive gear 23 for rotation of the compressor drive shaft 22. The compressor drive shaft 22 includes a clutch means generally designated by the numeral 24 in FIG. 2 for allowing selective engagement and disengagement of the compressor 13.

Figure 4:
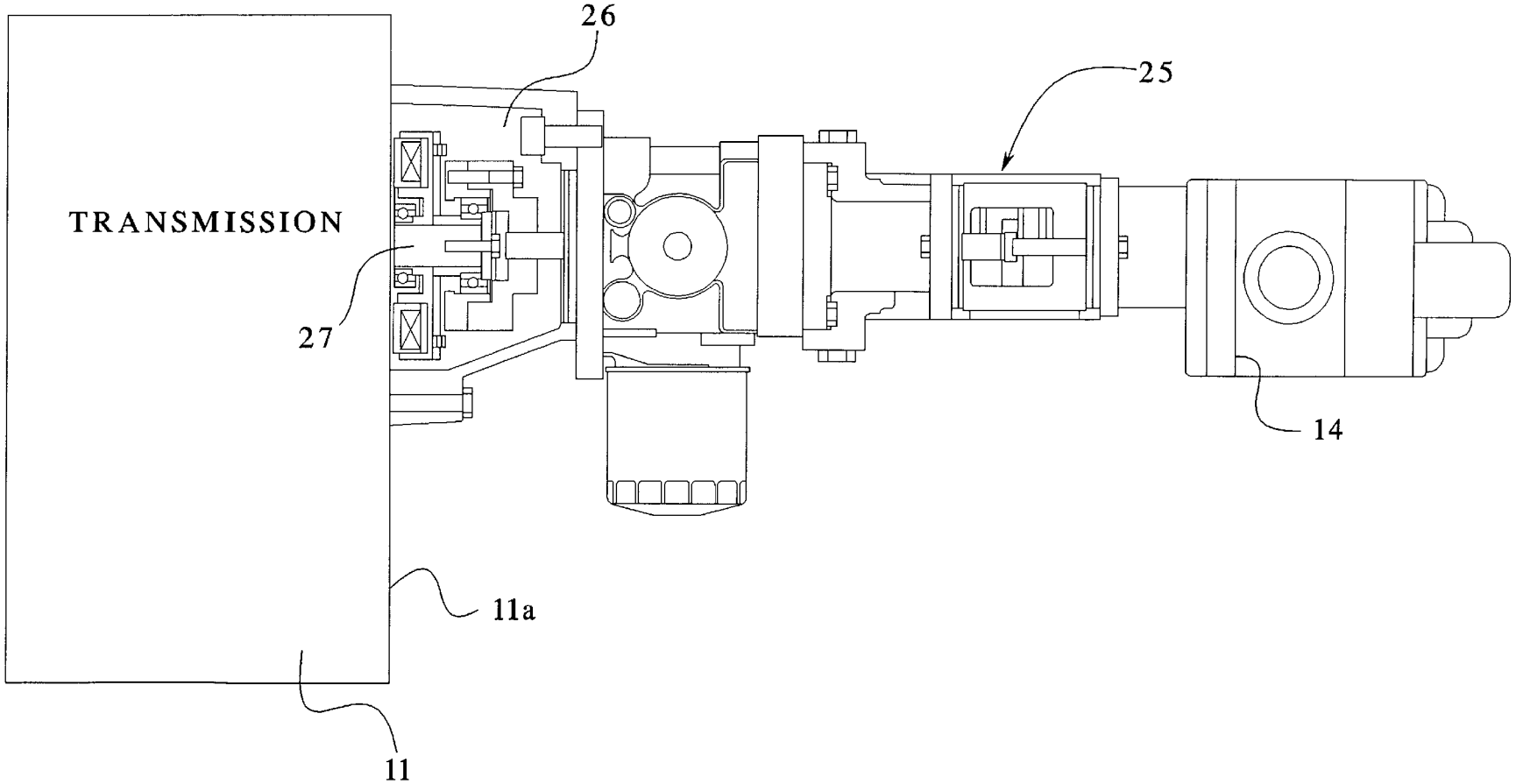
FIG. 4 is a somewhat schematic, side elevational view of the foam injection system of the present invention.

Referring to FIGS. 3 and 4, the foam pump 14 is connected to the transmission housing 11*a* by a drive train including a hydrostatic transmission 25 and a clutch 26. The clutch 26 is connected to a foam pump drive shaft 27 which has a foam pump drive gear 28 mounted thereon and positioned within the housing 11*a* of transmission 11. The foam pump drive gear 28 is positioned so that it is driven (directly or indirectly) by the intermediate gear 21. In the embodiment shown in FIG. 3, the foam pump drive gear 28 is shown in engagement with compressor drive gear 23. In such an arrangement, when slidable gear 17 engages and drives intermediate gear 21, the intermediate gear 21 drives compressor drive gear 23 which then drives the foam pump drive gear 28 and the foam pump drive shaft 27. Using a control panel (not shown), the operator can selectively engage or disengage the compressor 13 and/or the foam pump 14 by operating the compressor clutch 25 and the foam pump clutch 26, respectively.

The foam pump 14 may take the form of any one of a number of commercially available and conventional foam pumps. For example, the foam pump may take the form of a foam pump sold under the designation Series RP-07 by Viking Pump, Inc. of Cedar Falls, Iowa. Alternatively, the foam pump may take the form of a gear foam pump as described in co-owned U.S. Pat. No. 5,727,933 entitled "PUMP AND FLOW SENSOR COMBINATION", which is hereby incorporated by reference. However, it will be understood that other suitable foam pumps may also be employed in the present invention.

The foam pump clutch 26 may take the form of any one of a number of commercially available and conventional pump clutches. For example, the clutch 26 may take the form of a magnetic pump clutch sold under the designation MA-7FSP by Ogura Clutch Co. Ltd. of Japan. However, it will be understood that other suitable pump clutches may also be used.

While the clutch 26 can be used to selectively turn the foam pump 14 "on" or "off", the operating speed of the foam pump 14 is controlled by the hydrostatic transmission 25. The hydrostatic transmission 25 may take the form of any one of a number of commercially available and suitable hydrostatic transmissions. For example, the hydrostatic transmission 25 may take the form of a 15 Series Unit hydrostatic transmission available from Sauer Sunstrand Company of Ames, Iowa. However, other suitable hydrostatic transmissions may be employed with this invention.

Figure 5:
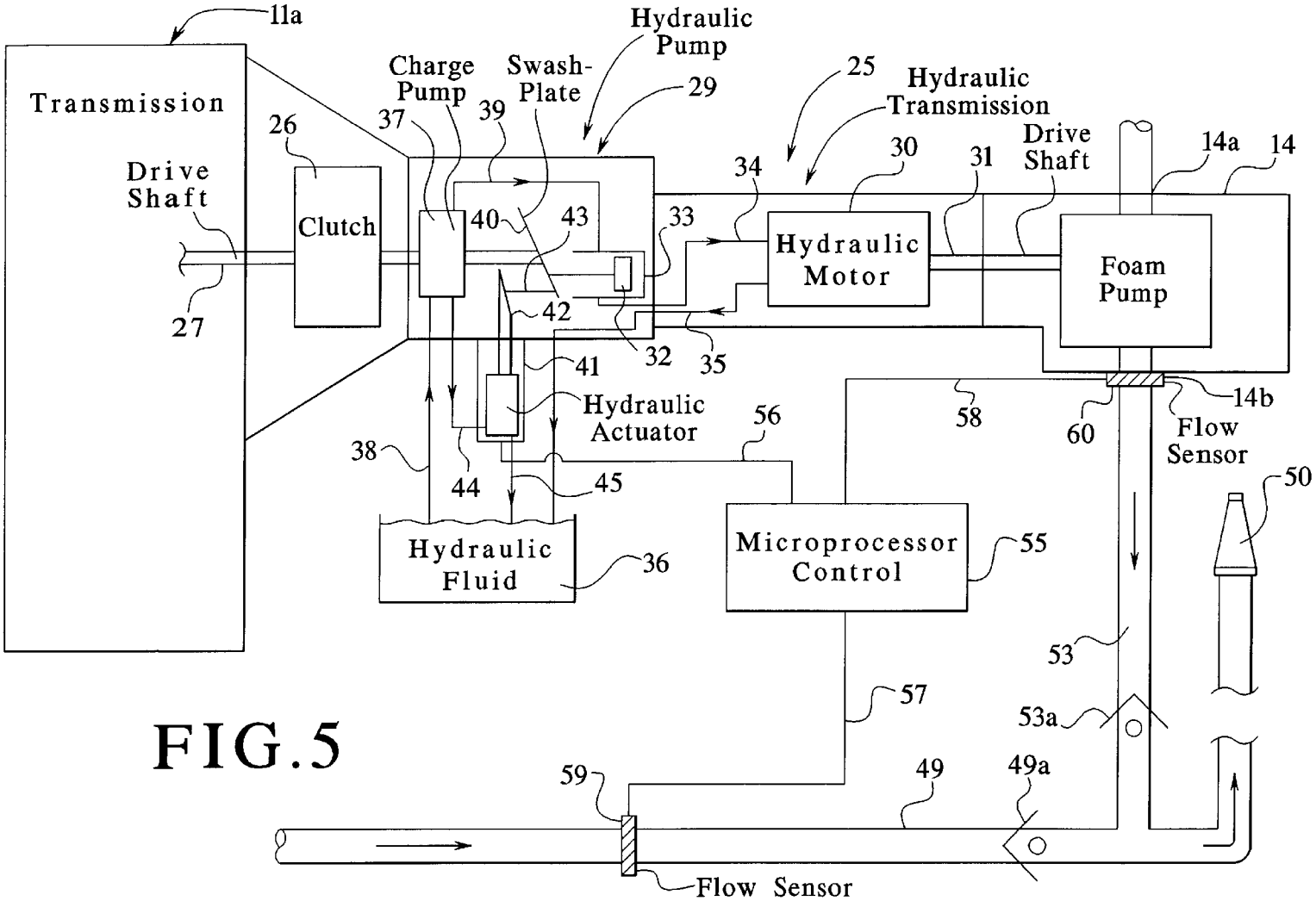
FIG. 5 is a schematic view of the foam injection system shown in FIG. 4.

The foam pump 14 and hydrostatic transmission 25 are schematically shown in FIG. 5 to more clearly illustrate the operation of those devices. The hydrostatic transmission 25 includes two main components: (a) a hydraulic pump generally designated at 29; and (b) a hydraulic motor generally designated at 30. The foam pump drive shaft 27 passes through clutch 26 to power the hydraulic pump 29 which in turn drives the hydraulic motor 30. The hydraulic motor includes a drive shaft 31 which in turn drives the foam pump 14. The speed of the hydraulic motor 30 and the resultant speed of the foam pump 14 are controlled by adjusting the displacement of the hydraulic pump 29.

In particular, the hydraulic pump 29 is a variable displacement hydraulic pump having a piston 32 and a chamber 33. The chamber 33 is connected to an output line 34 for circulating hydraulic fluid through the hydraulic motor 30. The motor 30 is also connected to a return line 35 for returning the hydraulic fluid to a hydraulic fluid reservoir 36. The hydraulic fluid is supplied to the pump 29 by a charge pump 37 which draws hydraulic fluid through a line 38 from the hydraulic reservoir 36 and pumps pressurized fluid through output line 39 to the piston chamber 33 of the pump 29. The charge pump 37 is operatively connected to the drive shaft 27 and is powered by same.

The displacement of hydraulic pump 29 is controlled by the orientation of a swashplate 40 which powers the movement of piston 32 within chamber 33. The swashplate 40 is rotated by driveshaft 27, and the orientation or angle of the swashplate 40 may be adjusted using a variety of mechanisms. For example, the hydrostatic transmission 25 (which may be 15 Series Unit hydrostatic transmission commercially available from Sauer Sunstrand Company) may include an opening (not shown) for permitting an actuator to be connected to the hydrostatic transmission 25 for mechanically adjusting the orientation of the swashplate 40 and thus the displacement of the hydraulic pump 29.

The mechanism for controlling the displacement of the pump 29 may take the form of any one of a number of conventional actuating mechanisms. In the embodiment shown in FIG. 5, the means for controlling the displacement of pump 29 takes the form of a hydraulic actuator 41 having a mechanical rod 42 that controls the orientation of the swashplate 40. For purposes of illustration, the mechanical rod 42 is schematically shown as including an inclined surface and being in contact with a rod 43 for tilting or adjusting the orientation of the swashplate 40. However, it will be understood that the actual mechanism for adjusting the orientation of the swashplate 40 may be more complex.

The charge pump 37 includes an output line 44 for providing pressurized hydraulic fluid to the hydraulic actuator 41 and a return line 45 is provided for returning the hydraulic fluid from the actuator 41 to the hydraulic fluid reservoir 36. The pressurized hydraulic fluid provides a power source for moving rod 42, and the hydraulic actuator 41 operates in response to an electrical signal from the control system as described in detail hereinbelow. Such a hydraulic actuator 41 may take the form of any one of a number of commercially available hydraulic actuators. For example, the hydraulic actuator 41 may take the form of a remote proportional actuator commercially available from Dynex/Rivett Inc. of Pewaukee, Wis. Such a hydraulic actuator may be readily bolted to the hydrostatic transmission 25.

Figure 6:
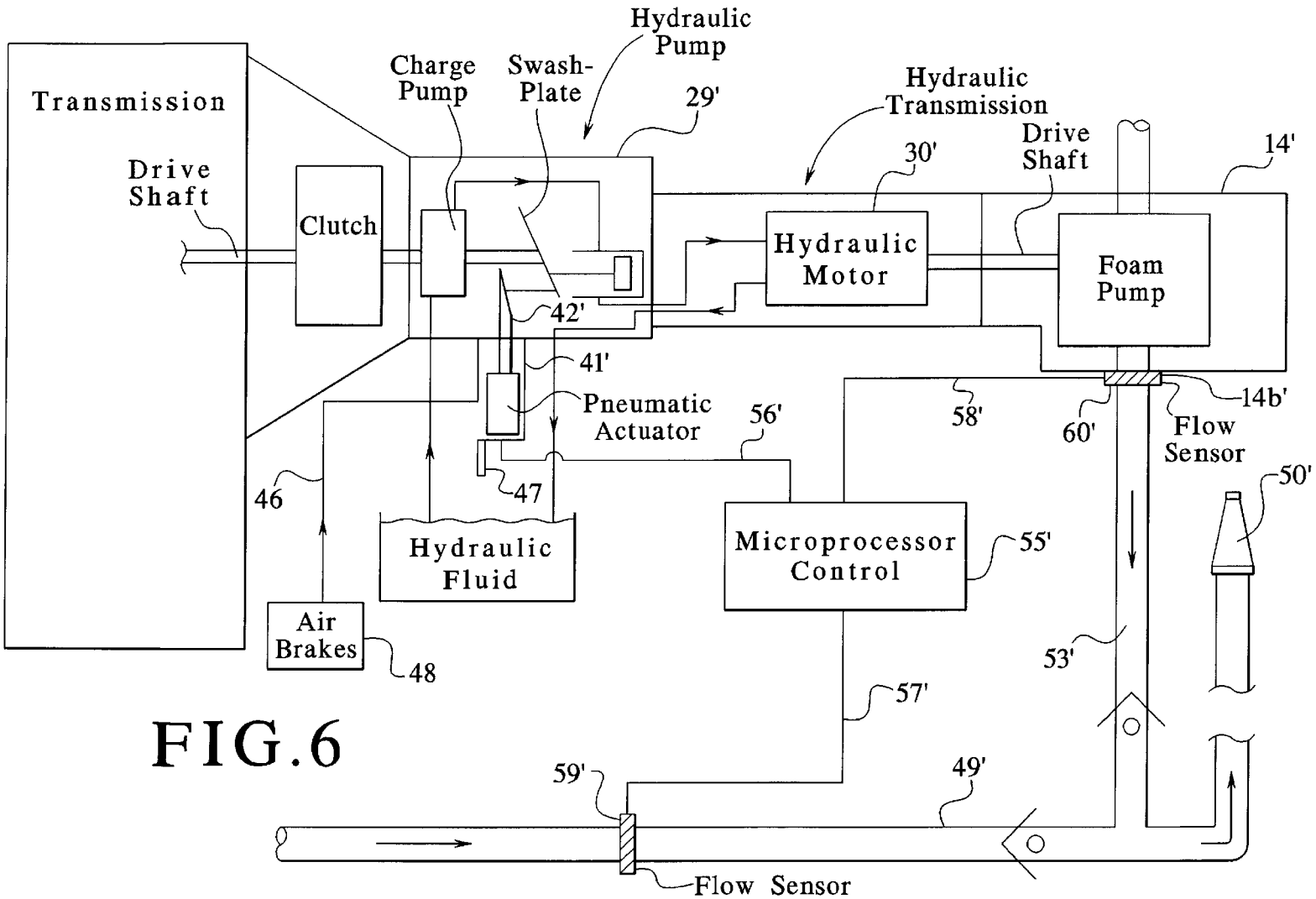
FIG. 6 is a schematic view of an alternate embodiment of the foam injection system of the present invention.

In an alternate embodiment shown in FIG. 6, the actuator 41' is generally the same as previously described except that it does not use hydraulic fluid for its operation. Instead, the actuator 41' is a pneumatic actuator and includes output line 46 and an air exhaust 47 with the output line 46 being connected to a source of compressed air 48. The actuator 41' uses the compressed air to operate the actuating rod 42, and the actuator 41' acts in response to an electrical signal from the control system. The source of compressed air 48 may advantageously take the form of the compressor for the air brakes of a fire fighting truck, for example. Control of air may come from electronic proportional air regulators such as sold under model No. SPC.7R by Buzzmatics of Newell, W. Va.

Figure 7:
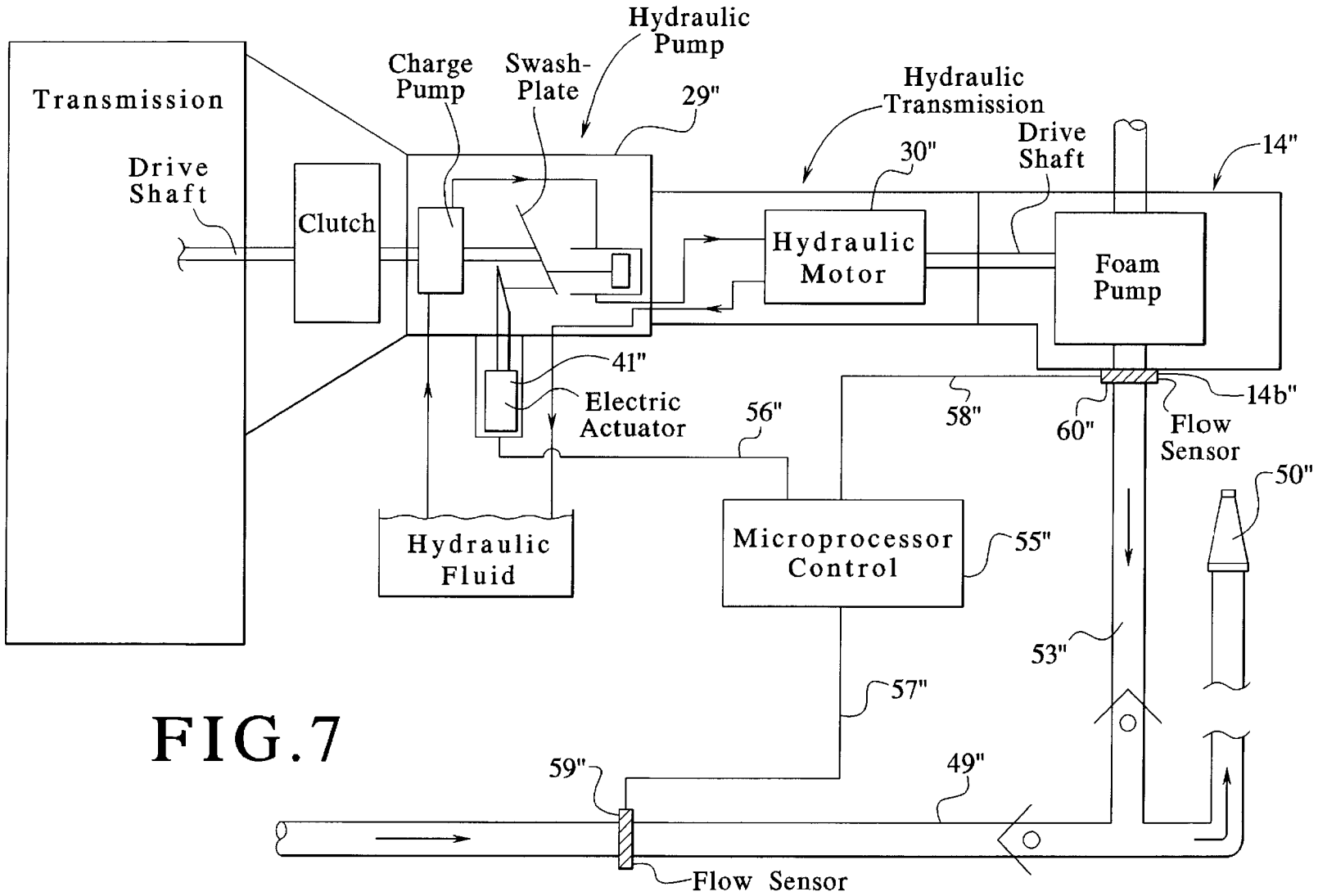
FIG. 7 is a schematic view of an alternate embodiment of the foam injection system of the present invention.

In another alternate embodiment shown in FIG. 7, the actuator 41" takes the form of an electric actuator for actuating rod 42. The actuator 41" may be powered by the electrical system of a fire truck, for example, and the electric actuator 41" acts in response to an electrical signal from the control system. It will also be understood that the actuator 41 may take the form of other suitable actuating mechanisms that are well known in the art.

Referring to the general aspects of the system as shown in FIG. 1, the pump 12 includes a pump inlet **12*a* and a pump outlet 12*b*. The outlet 12*b* is connected to a first conduit 49 that may take the form of a fire hose having a nozzle 50 at its end. The first conduit 49 is adapted for delivering a fire stream to a fire by circulating a firefighting fluid through the hose 49 and nozzle 50** and onto a fire.

The foam pump 14 includes a foam inlet **14*a* and a foam outlet 14*b*. The foam inlet 14*a* is connected to a conduit 51 that is in fluid communication with a foam supply tank 52. The foam outlet 14*b* is connected to a second conduit 53 which is in fluid communication with the first conduit 49 for injecting chemical foamant into the fluid flowing through the first conduit 49 to create a foamed fire stream. The first and second conduits 49 and 53, respectively, include check valves 49*a* and 53*a*** to prevent backflow.

The air compressor 13 includes an air inlet **13*a* and an air outlet 13*b*. The air outlet 13*b* is connected to a third conduit 54 that is in fluid communication with the first conduit 49 for injecting compressed air from the air outlet 13*b* of the compressor 13 into the fluid passing through the first conduit 49 to create an aerated fire stream. The air compressor 13** is optional.

Figure 8:
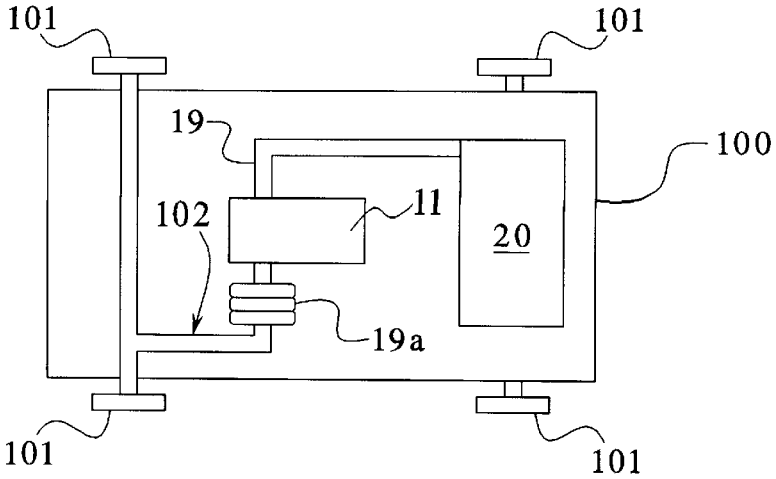
FIG. 8 is a schematic view of a fire truck.

Referring to FIGS. 1 and 2, the water pump 12, air compressor 13, and foam pump 14 are connected to and mounted on (directly or indirectly) the housing **11*a* of the transmission 11. As shown most clearly in FIG. 2, the transmission 11, water pump 12, air compressor 13, and foam pump 14 form a modular or unitary system that can be sold as a unit for incorporation into a firefighting apparatus such as a fire truck. Advantageously, the system 10 includes only one input shaft 19 for connection to a single power source in order to provide power for the water pump 12, air compressor 13, and foam pump 14. FIG. 8 schematically illustrates such a fire truck 100 including an engine 20 connected to drive shaft 19 to drive transmission 11 and also having an additional output 19***a* connected to a driving system 102 for driving wheels 101 of the fire truck 100. It will be understood that FIG. 8 is merely a schematic representation of an example of a fire truck.

Referring to FIGS. 5, 6 and 7, the systems 10 respectively include a control system for controlling the speed of the foam pump 14, 14', and 14" to control the proportion of chemical foamant that is output by the foam pump 14, 14', and 14" and injected into the fire stream within the first conduit 49, 49', and 49". In the embodiments shown in the drawings, the control systems respectively include a microprocessor control 55, 55', and 55" connected by a line 56, 56', or 56" to the actuator 41, 41', or 41". The microprocessor controls 55, 55', or 55" send electrical signals through lines 56, 55', or 56" to control the actuator 41 (or actuator 41' or 41") and thus the displacement of the respective hydraulic pump 29, 29' or 29". By varying the displacement of the hydraulic pump 29, 29' and 29", the microprocessor controls 55, 55', and 55" control the speed of the respective hydraulic motor 30, 31', or 31" and foam pump 14, 14', or 14".

The microprocessor controls 55, 55', and 55" act in response to signals respectively received through lines 57, 57', 57" and 58, 58', 58" from first and second flow sensors 59, 59', 59" and 60, 60', 60", respectively. The flow sensors 59, 59', and 59" measure the flow of fluid through the first conduits 49, 49', and 49", and the second flow sensors 60, 60' and 60" measure the amount of chemical foamant flowing through the second conduits 53, 53', and 53" from the outlets 14*b*, 14*b*', and 14*b*" of the foam pumps 14, 14', and 14". Based upon the signals received from the first and second flow sensors 59, 59', 59" and 60, 60', 60", the respective microprocessor controls 55, 55', and 55" selectively control the proportion of chemical foam to water (or other fluid) flowing through the first conduits 49, 49', and 49" and discharged through nozzles 50, 50', and 50" onto a fire. The microprocessor controls 55, 55', and 55" are preferably connected to a control panel (not shown) for selective adjustment by the operator.

The present invention advantageously employs a common gearbox or transmission 11 to drive the water pump 12, air compressor 13, and foam pump 14. By mounting the water pump 12, air compressor 13, and foam pump 14 on the transmission housing 11*a*, the firefighting system 10 takes a compact and modular form that may be easily incorporated into firefighting apparatuses such as a fire truck. The system 10 is also advantageously operated by a single power source by connecting transmission 11 to a single power source, such as engine 20 of a fire truck. The present invention also provides an advantageous drive train (the hydraulic transmission 25) for permitting precise control of the speed of the foam pump 14 and the resultant proportion of chemical foamant that is introduced into the water (or other fluid) flowing though hose 49 and discharged through nozzle 50 onto a fire.

While in the foregoing specification embodiments of the present invention have been described in considerable detail for purposes of illustration, it will be understood by those skilled in the art that the details given herein may vary considerably within the spirit and scope of the invention.

We claim:

1. A foam injection system for a firefighting apparatus, said system comprising:

the firefighting apparatus having a power source;

a transmission having a housing and a drive disposed in said housing for driving components connected to said transmission, said drive including an input shaft connected to said power source;

a water pump having a water pump drive shaft operatively connected to said drive of said transmission and having a water inlet and a water outlet;

a foam pump having a drive train operatively connected to said drive of said transmission and having a foam inlet and a foam outlet, said foam pump being connected to and mounted on said housing of said transmission;

a first conduit connected to said water outlet of said water pump for receiving fluid from said water pump and discharging said fluid through a nozzle; and a second conduit in fluid communication between said foam outlet of said foam pump and said first conduit for receiving foam from said foam outlet and injecting said foam into said fluid in said first conduit.

2. The system of claim 1 in which said drive train of said foam pump includes a clutch for selectively engaging and disengaging said foam pump.

3. The system of claim 2 in which said drive train further includes a hydrostatic transmission operatively connected to said drive of said transmission and to said foam pump for driving said foam pump.

4. The system of claim 3 in which said hydrostatic transmission includes speed adjustment mechanism adapted to control a speed of said foam pump.

5. The system of claim 4 in which said hydrostatic transmission further includes a hydraulic motor which drives said foam pump and said speed adjustment mechanism comprises a variable displacement hydraulic pump which circulates pressurized hydraulic fluid through and drives said hydraulic motor, whereby a speed of said hydraulic motor and of said foam pump can be adjusted by controlling a displacement of said variable displacement hydraulic pump.

6. The system of claim 5 further comprising a controller operatively connected to said variable displacement hydraulic pump of said hydrostatic transmission for varying the displacement of said variable displacement hydraulic pump to control the speeds of said hydraulic motor and said foam pump.

7. The system of claim 6 in which said controller comprises an actuator having an actuating rod capable of adjusting the displacement of said variable displacement hydraulic pump.

8. The system of claim 7 in which said actuator comprises a hydraulic actuator.

9. The system of claim 7 in which said actuator comprises a pneumatic actuator.

10. The system of claim 7 in which said actuator comprises an electric solenoid.

11. The system of claim 3 in which said clutch, said hydrostatic transmission, and said foam pump are connected to and mounted in series on said housing of said transmission.

12. The system of claim 11 in which said water pump is also connected to and mounted on said housing of said transmission.

13. The system of claim 1 in which said water pump is connected to and mounted on said housing of said transmission.

14. The system of claim 1 in which said system further includes:

an air compressor having an air compressor drive shaft operatively connected to said drive of said transmission and having an air inlet and an air outlet; and a third conduit connected to said air outlet of said air compressor and to said first conduit for injecting compressed air from said air outlet of said compressor into said fluid in said first conduit.

15. The system of claim 14 in which said water pump and said air compressor are connected to and mounted on said housing of said transmission.

16. The system of claim 1 in which said input shaft also includes a drive member for driving wheels of a fire truck.

17. A foam injection system for a fire fighting apparatus, said system comprising:

a transmission having a housing and a drive disposed within said housing for driving components connected to said transmission;

a water pump having a water pump drive shaft operatively connected to said drive of said transmission and having a water inlet and a water outlet;

a foam pump connected to and mounted on said housing of said transmission and having a drive train operatively connected to said drive of said transmission and having a foam inlet and a foam outlet, said drive train including a hydrostatic transmission;

a speed control mechanism operatively connected to said hydrostatic transmission for controlling a speed of said foam pump;

a first conduit connected to said water outlet of said water pump for receiving fluid from said water pump and discharging said fluid through a nozzle;

a second conduit in fluid communication between said foam outlet of said foam pump and said first conduit for receiving foam from said foam outlet and injecting said foam into said fluid in said first conduit;

a first flow sensor connected to said first conduit for producing a first signal indicative of a flow rate of the fluid flowing through said first conduit;

a second flow sensor for producing a second signal indicative of a flow rate of the foam flowing through said second conduit; and a controller for receiving said first and second signals from said first and second flow sensors and for selectively controlling the speed of said foam pump and a proportion of the foam injected into the fluid flowing through said first conduit.

18. The system of claim 17 in which said system further includes:

an air compressor having an air compressor drive shaft operatively connected to said drive of said transmission and having an air inlet and an air outlet; and a third conduit connected to said air outlet of said air compressor and to said first conduit for injecting compressed air from said air outlet of said compressor into said fluid in said first conduit.

19. The system of claim 18 in which said water pump and said air compressor are mounted on said housing of said transmission.

20. The system of claim 17 in which said hydrostatic transmission includes a hydraulic motor which drives said foam pump and a variable displacement hydraulic pump connected to said drive of said transmission and to said hydraulic motor for circulating hydraulic fluid though and driving said hydraulic motor.

21. The system of claim 20 in which said speed control mechanism comprises an actuator adapted to adjust a displacement of said variable displacement hydraulic pump.

22. The system of claim 21 in which said actuator comprises one of a hydraulic actuator, a pneumatic actuators and an electric solenoid.

* * * * *